US006624575B2

(12) United States Patent
Nishiki et al.

(10) Patent No.: US 6,624,575 B2
(45) Date of Patent: Sep. 23, 2003

(54) METHOD OF MAKING GAS DISCHARGE DISPLAY PANEL AND GAS DISCHARGE DISPLAY DEVICE

(75) Inventors: Masashi Nishiki, Yokohama (JP); Ryohei Satoh, Yokohama (JP); Yuzo Taniguchi, Kodaira (JP); Shigeaki Suzuki, Fujisawa (JP); Michifumi Kawai, Tokyo (JP); Masahito Ijuin, Fujisawa (JP); Akira Yabushita, Yokohama (JP); Tomohiro Murase, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/061,160

(22) Filed: Feb. 4, 2002

(65) Prior Publication Data

US 2002/0089285 A1 Jul. 11, 2002

Related U.S. Application Data

(60) Continuation of application No. 09/851,989, filed on May 10, 2001, now Pat. No. 6,343,967, which is a division of application No. 09/225,552, filed on Jan. 5, 1999, now Pat. No. 6,429,586.

(30) Foreign Application Priority Data

Feb. 13, 1998 (JP) ..... 10-030840

(51) Int. Cl.[7] ..... H01J 17/49
(52) U.S. Cl. ..... 313/583; 313/582; 313/585
(58) Field of Search ..... 313/483–485, 313/582–585; 315/169.1, 169.3, 169.4; 345/60, 67–68

(56) References Cited

U.S. PATENT DOCUMENTS

| | | | | |
|---|---|---|---|---|
| 5,246,745 | A | 9/1993 | Baum et al. | |
| 5,276,382 | A | 1/1994 | Stocker et al. | |
| 5,314,709 | A | 5/1994 | Doany et al. | |
| 5,889,365 | A | 3/1999 | Tanabe | |
| 5,900,694 | A | 5/1999 | Matsuzaki et al. | |
| 5,952,782 | A | 9/1999 | Nanto et al. | |
| 5,977,708 | A | 11/1999 | Amatsu et al. | |
| 6,429,586 | B1 * | 8/2002 | Nishiki et al. | 313/582 |

FOREIGN PATENT DOCUMENTS

| | | |
|---|---|---|
| JP | 7-220641 | 8/1995 |
| JP | 9-035628 | 2/1997 |
| JP | 9-147737 | 6/1997 |

* cited by examiner

*Primary Examiner*—Vip Patel
*Assistant Examiner*—Joseph Williams
(74) *Attorney, Agent, or Firm*—Antonelli,Terry,Stout, & Kraus, LLP

(57) ABSTRACT

A gas discharge display device having a first substrate, a plurality of first electrodes having a substantially rectangular form being arranged on the first substrate, a plurality of second electrodes, respective ones of the plurality of second electrodes being formed on respective ones of the plurality of first electrodes, and each of the plurality of second electrodes having an extension extending beyond an end of a respective one of the plurality of first electrodes on which respective ones of the plurality of second electrodes are formed and in an oblique direction therefrom. The extension of the plurality of second electrodes extend beyond opposite ends of alternate ones of the plurality of first electrodes.

6 Claims, 17 Drawing Sheets

METHOD OF MAKING GAS DISCHARGE DISPLAY PANEL AND GAS DISCHARGE DISPLAY DEVICE

CROSS REFERENCE TO RELATED APPLICATION

This is a continuation of U.S. application Ser. No. 09/851,989, filed May 10, 2001, now U.S. Pat. No. 6,343,967, which is a divisional of U.S. application Ser. No. 09/225,552, filed Jan. 5, 1999, now U.S. Pat. No. 6,429,586, the subject matter of which incorporated by reference herein.

BACKGROUND OF THE INVENTION

This invention relates to a structure of a gas discharge display panel and a gas discharge display device.

Gas discharge display devices, such as a plasma display device and the like, produce a display through self-luminescence and, therefore, are characterized in that the field angle is large, the display is easy to see, the thickness can be reduced, and a large picture plane can be realized. Thus, such gas discharge display devices have been used extremely as display devices of information terminal equipment and high-quality picture tubes for television.

Plasma displays are roughly classified into a direct current driving type and an alternate current driving type. Among them, the alternate current type of plasma display exhibits a high luminance owing to the memory action of a dielectric layer covering the electrodes, and its lifetime has reached a practical level through formation of a protective layer thereon. This results in practical application of plasma displays to video monitors for many uses.

FIG. 10 is a perspective view illustrating the structure of a conventional plasma display panel, wherein the front side substrate 100 is separated from the back side substrate 200 to expose a discharge space region 300 for the purpose of facilitating understanding of the structure. The front side substrate 100 comprises display electrodes 600 made of a transparent conductive material such as ITO (indium tin oxide), tin oxide ($SnO_2$) or the like, a bus electrodes 700 made of a low-resistance material, a dielectric layer 800 made of a transparent insulating material and a protecting layer 900 made of magnesium oxide (MgO) or the like, all being formed on a front side glass substrate 400.

The back side substrate 200 comprises address electrodes 1000, barrier ribs 1100 and a fluorescent material layer 1200, all formed on a back side glass substrate 500. Although not shown in FIG. 10, a dielectric layer 1300 is formed on the address electrodes 1000 as well. By affixing the front side substrate 100 to the back side substrate 200 so that the display electrodes 600 form an approximately right angle with the address electrodes 1000, a discharge space region 300 is formed between the front side substrate 100 and the back glass side substrate 500.

In this gas discharge display panel, an alternating current voltage is applied between one pair of display electrodes 600 provided on the front side substrate 100, and a voltage is applied between an address electrode 1000 provided on the back side substrate 200 and a display electrode 600, whereby an address discharge is made to occur and a main discharge is generated in a prescribed discharging cell. The main discharge generates ultraviolet rays, which produces emission of light from the red-, green- and blue-color fluorescent materials 1200 separately coated on respective discharging cells. A display is produced by emission of such light.

An example of such prior gas discharge display devices of this type are described in, for instance, FLAT PANEL DISPLAY 1996 (edited by Nikkei Microdevice, 1995), pages 208–215.

Now, a major desire in the gas discharge display device field is to shorten the manufacturing time of the gas discharge display device. For shortening the manufacturing time of the gas discharge display device, we have developed a method to form display electrodes 600 and bus electrodes 700 on a front substrate 100 using a laser process instead of using the more common photolithography process. The laser process does not require masks and resist, which are used in the photolithography process, to form wiring on a substrate. So the laser process is an advantageous technique from the point of view of product cost, as well as production time.

However, the laser equipment used for such manufacture doesn't scan in an oblique direction, but must scan a beam or a stage in the XY direction to form obliquely directed wiring on the substrate. On the other hand, the display electrodes 600 and bus electrodes 700 of the gas discharge display device have obliquely directed wiring. The obliquely directed wiring is connected to an external connection terminal, and lies outside of a display area of the gas discharge display panel. The display area is an area which operates as a substantial picture display region.

Accordingly, when this oblique wiring is processed by the laser equipment, this laser forming of the oblique wiring needs more than double the manufacturing time of a laser forming of a straight line wiring because the laser equipment is able to scan a beam or a stage in only the XY direction to form obliquely directed wiring on the substrate.

SUMMARY OF THE INVENTION

It is an object of the present invention to provide an improved gas discharge display panel and gas discharge display device for which the laser operating time required to form wiring on a substrate thereof is shortened.

In order to achieve the object mentioned above, this invention provides a gas discharge display panel which is provided with a first substrate having a plurality of first electrodes and a plurality of second electrodes, said first electrodes being formed with approximately a rectangular form by a laser process, said second electrodes being formed on the first electrodes, and a second substrate having a plurality of third electrodes and being opposed to the first substrate.

Further, it is desirable that said second electrodes are formed either by a photolithography process or a laser process, and said first electrodes are formed by a laser process after the second electrodes are formed by the photolithography process or the laser process.

Further, it is desirable that said first electrodes are made of the transparent material, such as ITO (Indium Tin Oxide) or $SnO_2$, and said second electrodes are made of a material, such as Ag or Cr/Cu/Cr layers, the resistance value of such material being lower than that of the transparent material.

Further, this invention forms a gas discharge display device provided with a gas discharge display panel including a first substrate having a plurality of first electrodes and a plurality of second electrodes, said first electrodes being formed with approximately a rectangular form by a laser process, and said second electrodes being formed on the first electrodes and being formed to extend from the first electrode to an external connection terminal, and a second substrate having a plurality of third electrodes and being opposed to the first substrate, and a drive circuit electrically connected to the external connection terminal of the gas discharge display panel.

Further, it is desirable that said second electrodes are formed by a photolithography process or a laser process, and said first electrodes are formed by a laser process after the second electrodes are formed by the photolithography process or the laser process.

Further, it is desirable that said first electrodes are made of the transparent material, such as ITO or $SnO_2$, and said second electrodes are made of a material, such as Ag or Cr/Cu/Cr layers, the resistance value of such material being lower than that of the transparent material.

When the first electrodes are to be formed to have a rectangular form, this can be accomplished by scanning the beam or the stage of the laser equipment in a constant direction, such as the X direction. Therefore, the overall manufacturing throughput according to this invention is improved as compared to conventional manufacture of a display device which has obliquely directed wiring. Also, when the first electrode is film-formed material on a limited area of the substrate, rather than on the whole area of the substrate, it is possible to reduce the material cost in addition to improving the throughput. This is because it is possible to form the first electrodes into a rectangle of an optimum size by scanning the beam or the stage of the laser equipment in a constant direction, such as the X direction.

In this case, to obtain a certain discharging phenomenon, it is desirable for the first electrode material layer to be film-formed to cover the gas discharging area. Also, when the second electrode material is film-formed after processing the first electrode, the particles which adhere to the first electrode at the time of laser manufacture influence the formation of the second electrode. Therefore, it is desirable that the first electrode material and the second electrode material are film-formed, respectively, the second electrode being formed by a photolithography process or a laser process, and the first electrode being formed by a laser process after forming the second electrode. As a result, breakage of the second electrode can be suppressed.

DETAILED DESCRIPTION OF THE INVENTION

Various embodiments of this invention will be described below with reference to the accompanying drawings.

Figure 1:
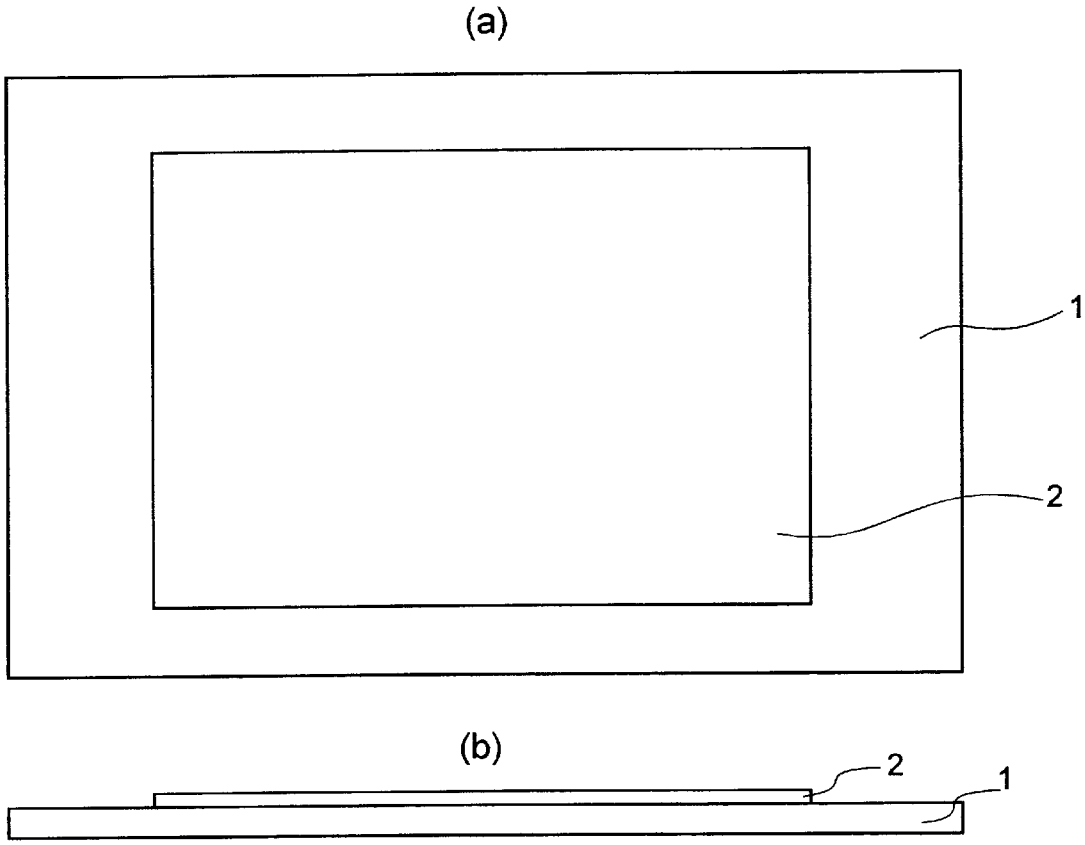
FIG. 1(*a*) is a top plan view and FIG. 1(*b*) is a side view of a substrate illustrating one of the embodiments of this invention during a step of the manufacture thereof.
Figure 3:
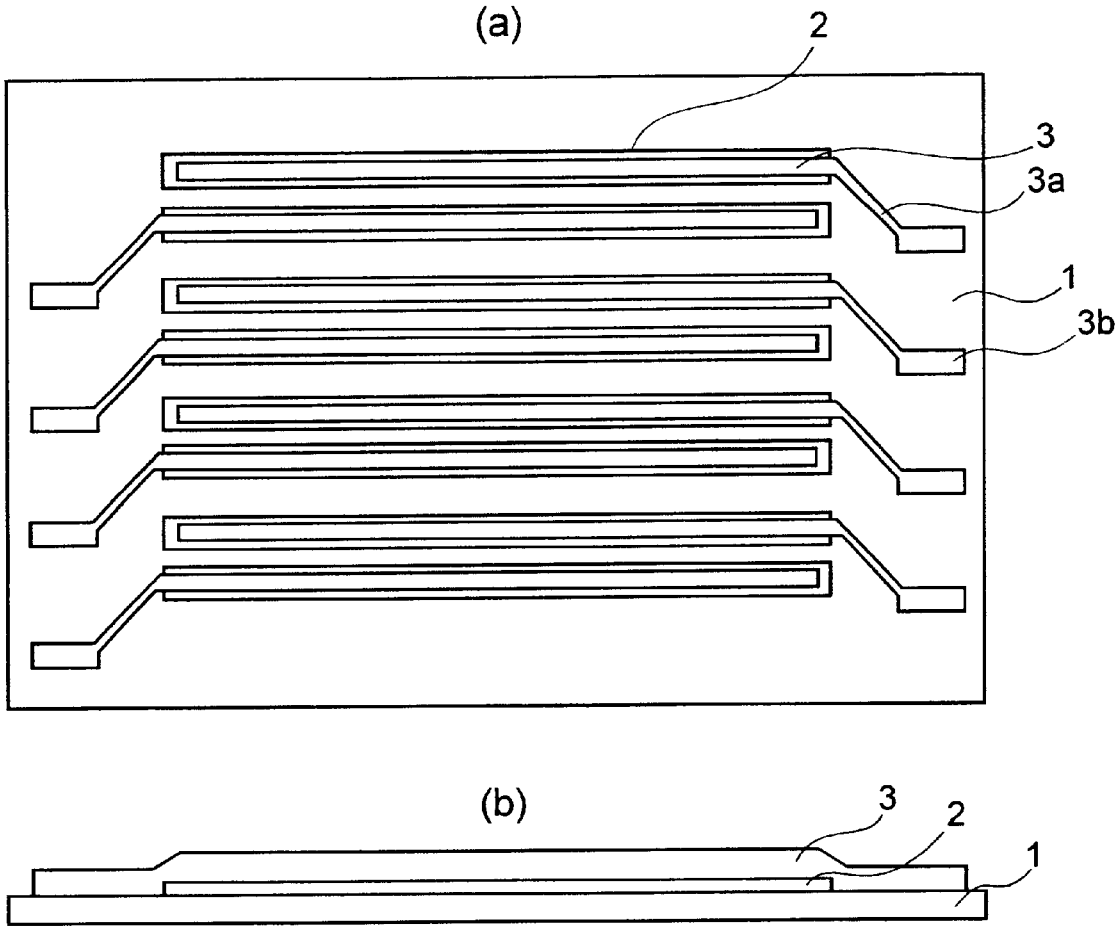
FIG. 3(*a*) is a top plan view and FIG. 3(*b*) is a side view of a substrate illustrating one of the embodiments of this invention during a following step in the manufacture thereof.
Figure 11:
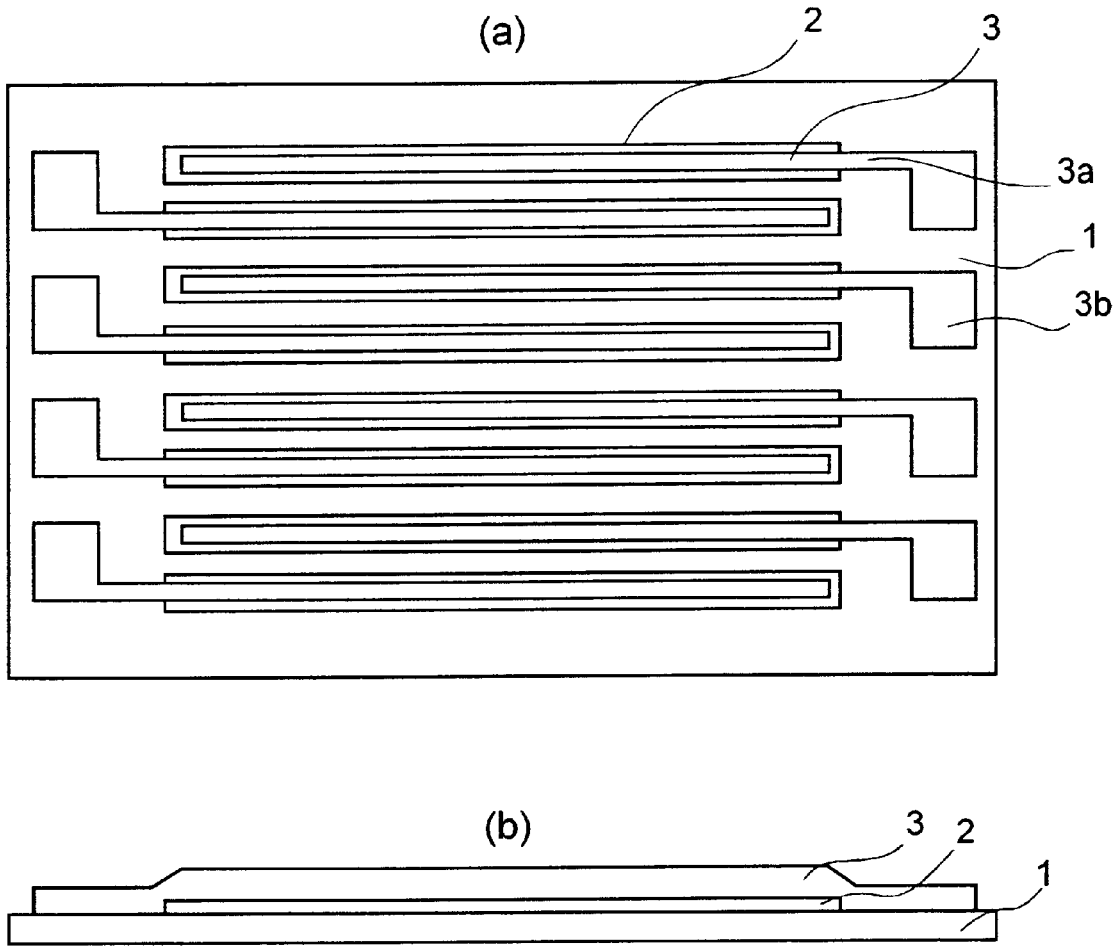
FIG. 11(*a*) is a top plan view and FIG. 11(*b*) is a side view of a substrate illustrating one of the embodiments of this invention having another form of external connection terminal.

FIG. 1(*a*)–FIG. 3(*b*) and FIG. 11(*a*) and FIG. 11(*b*) illustrate the structure and process of manufacture of a front substrate to which the present invention is applied. FIG. 1(*a*) is a top plan view of glass substrate 1, and FIG. 1(*b*) is a side view of the glass substrate 1.

In the drawings, 1 denotes a glass substrate, 2 denotes display electrodes, which are transparent electrodes made of a material such as ITO or $SnO_2$, and 3 denotes bus electrodes, which are low-resistance electrodes made of a material such as Ag, Cr/Cu/Cr. The resistance value of the bus electrodes 3 is less than that of the display electrodes 2. Each bus electrode 3 is formed on a display electrode 2.

First, as shown in FIG. 1(*a*), transparent material such as ITO is film-formed on a limited area of the glass substrate 1 by sputtering.

Figure 2:
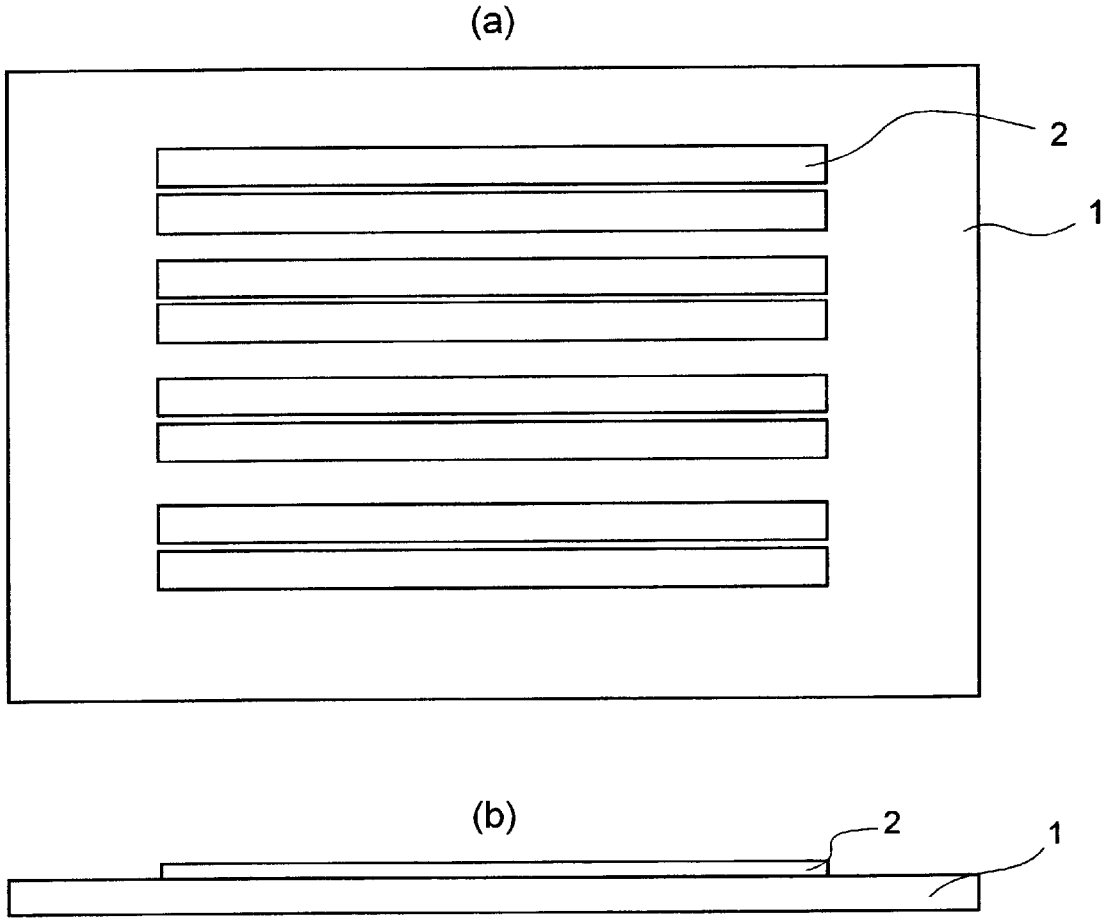
FIG. 2(*a*) is a top plan view and FIG. 2(*b*) is a side view of a substrate illustrating one of the embodiments of this invention during a subsequent step of the manufacture thereof.

Subsequently, as shown in FIG. 2(*a*), a laser device, such as a YAG laser, processes this film-formed transparent material to form nearly rectangular display electrodes 2. In this case, processing is performed by scanning a beam or a stage in the only X or Y direction in the laser device to obtain a plurality of display electrodes 2 having a rectangular-form. The display electrodes 2 are formed parallel to each other.

Subsequently, as shown in FIG. 3(*a*) or FIG. 11(*a*), an electrode material for the bus electrodes 3 is film-formed on the display electrodes 2 by sputtering. The bus electrodes 3 are formed by a photolithography process and an etching process. Each bus electrode 3 extends from a respective display electrode 2 via a wiring 3*a* to a peripheral portion of the glass substrate 1, where an external connection terminal 3*b* is provided for electrical connection to an external circuit. In this case, the external connection terminals 3*b* are arranged alternately on both sides of the glass substrate 1. One picture element is formed at an intersection point of a paired bus electrode 3 and address electrode(not shown in FIG. 3(*a*)). When one of the paired bus electrodes 3 is an X electrode and the other of the paired bus electrodes 3 is a Y electrode, it is desirable that all X electrodes or all Y electrodes to be electrically connected with each other as common electrode.

Also FIG. 11(*a*) shows an embodiment where the bus electrodes are formed by a laser process, rather than a photolithography process. Each bus electrode 3 also extends from a display electrode 2 via a wiring 3*a* to a peripheral portion of the glass substrate 1 where an external connection terminal 3*b* is provided for electrical connection to an external circuit. In this case, the external connection terminals 3*b* are arranged alternately on both sides of the glass substrate 1. When one of the paired bus electrodes 3 is an X electrode and the other of the paired bus electrodes 3 is a Y electrode, it is desirable for all X electrodes or all Y electrodes to be electrically connected with each other as a common electrode.

Figure 15:
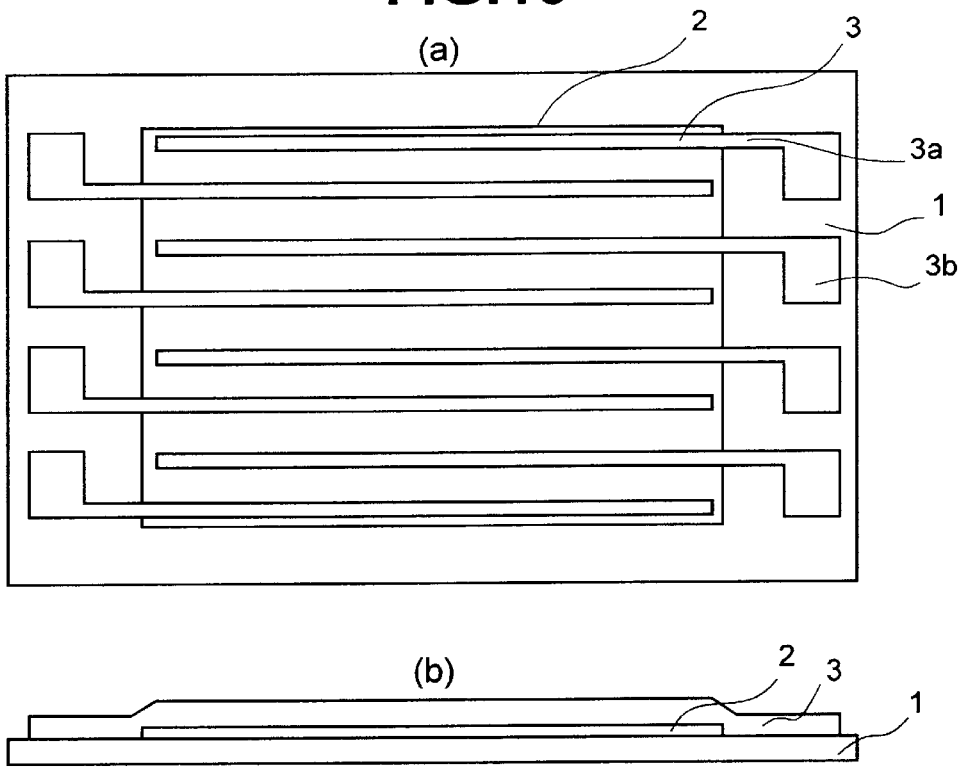
FIG. 15(*a*) is a top plan view and FIG. 15(*b*) is a side view of a substrate illustrating one of the embodiments of this invention.

Also, as shown in FIG. 15(*a*), it is possible to form the bus electrode 3 by a laser process instead of a photolithography process. In FIG. 15(*a*) there is no obliquely directed wiring among the bus electrodes 3 or the display electrodes 2, so that it is possible to shorten the manufacturing time of the bus electrodes 3. Each bus electrode 3 has a rectangular portion for the external connection terminal 3*b* and a rectangular bus electrode portion in the display area, and the wiring 3*a* drawn from the bus electrode portion in the display area to the external connection terminal 3*b* is also rectangular. It is possible to shorten the manufacturing time of laser processing as a result of such a configuration. By turning the laser light on and off, these desired electrode shapes can be processed.

In the manufacturing process, films, such as a dielectric layer and a protection MgO layer are formed to complete the front substrate. Also, the rear substrate, which has the address electrodes and barrier ribs etc., are formed. After that, the front substrate and the rear substrate are assembled. The assembled front substrate and rear substrate are then sealed, and discharging gas also is injected into the final product.

Figure 4:
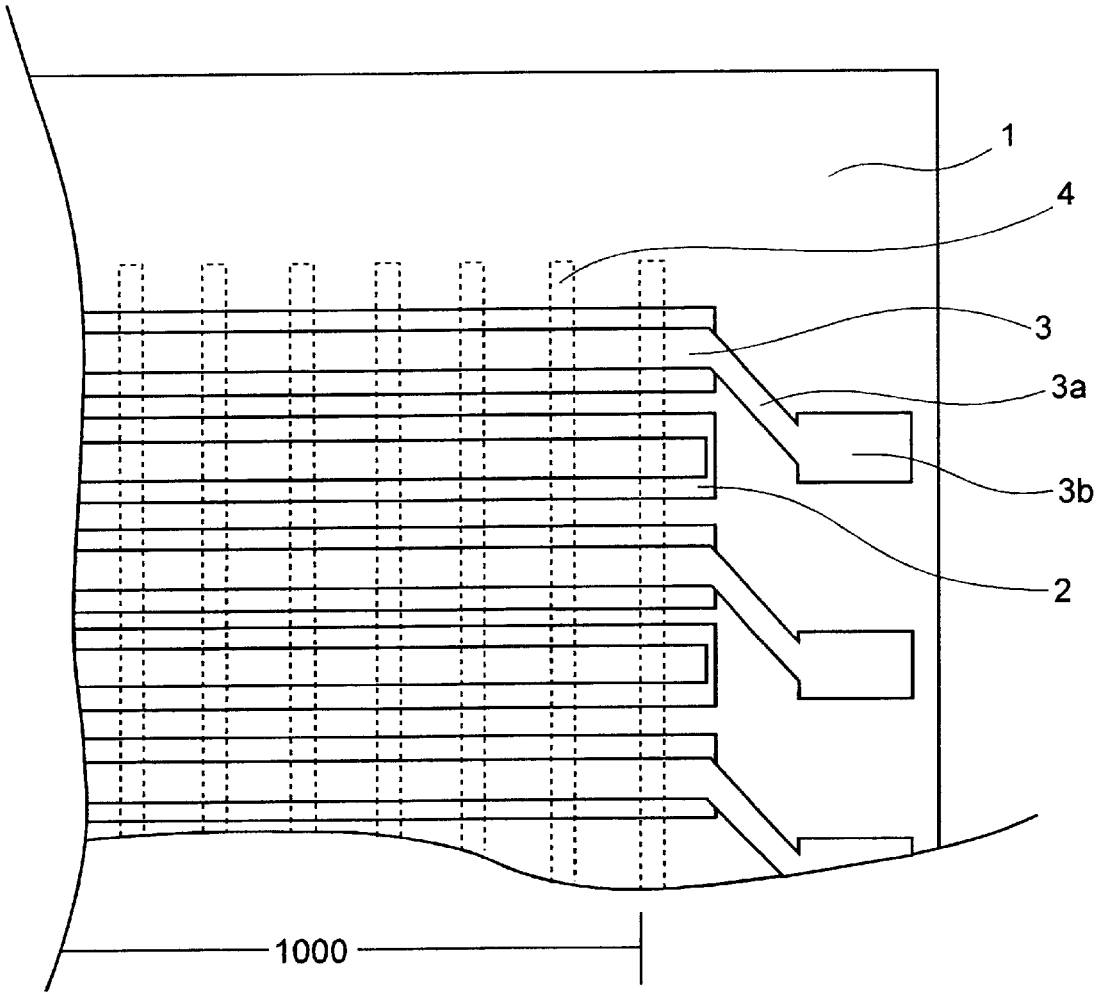
FIG. 4 is a detailed plan view illustrating one of the embodiments of this invention.
Figure 12:
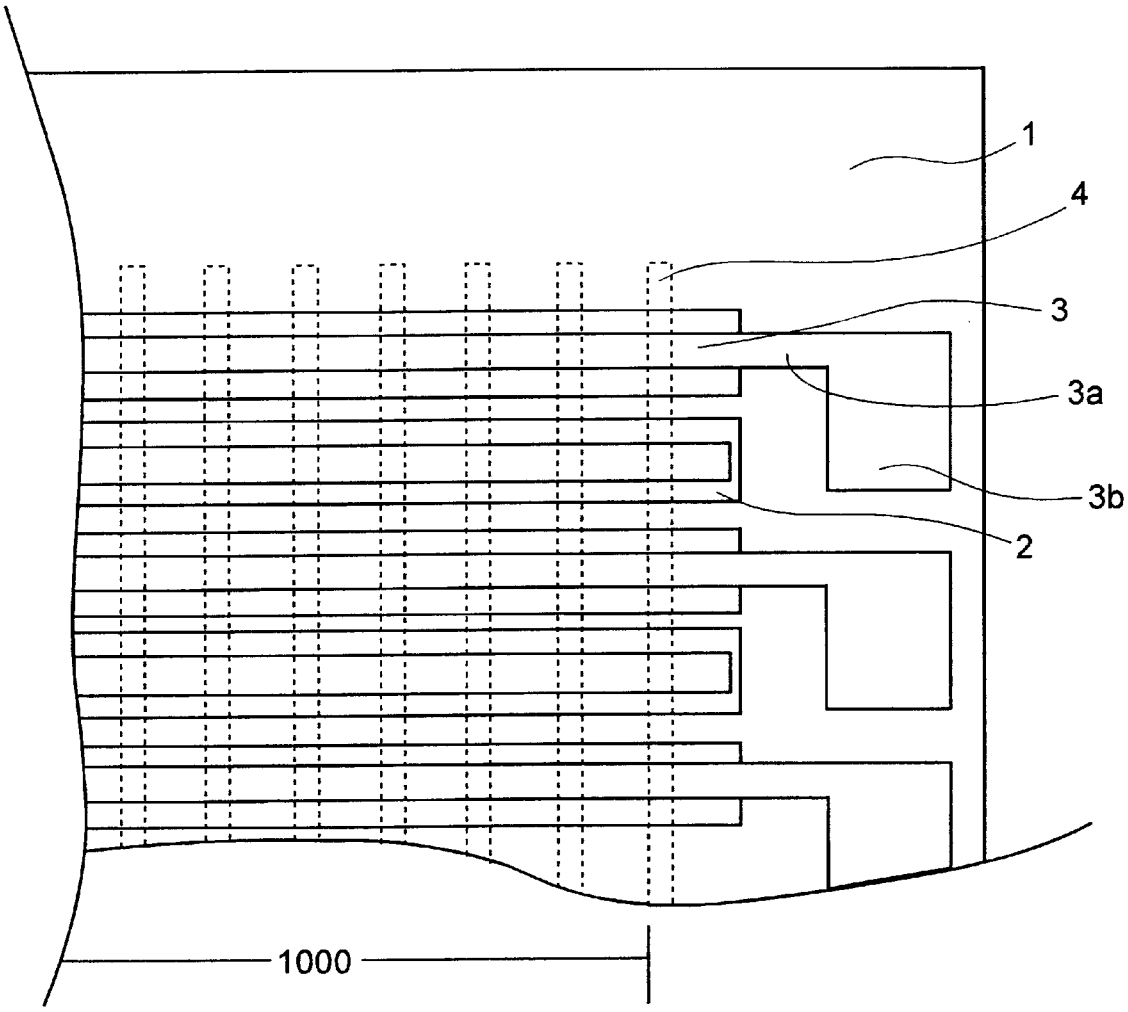
FIG. 12 is a detailed plan view illustrating one of the embodiments of this invention.

FIG. 4 and FIG. 12 illustrate examples of the positional relationship between the display electrodes 2 and bus electrodes 3 and barrier ribs 4. The barrier ribs 4 are formed on the rear substrate.

Figure 13:
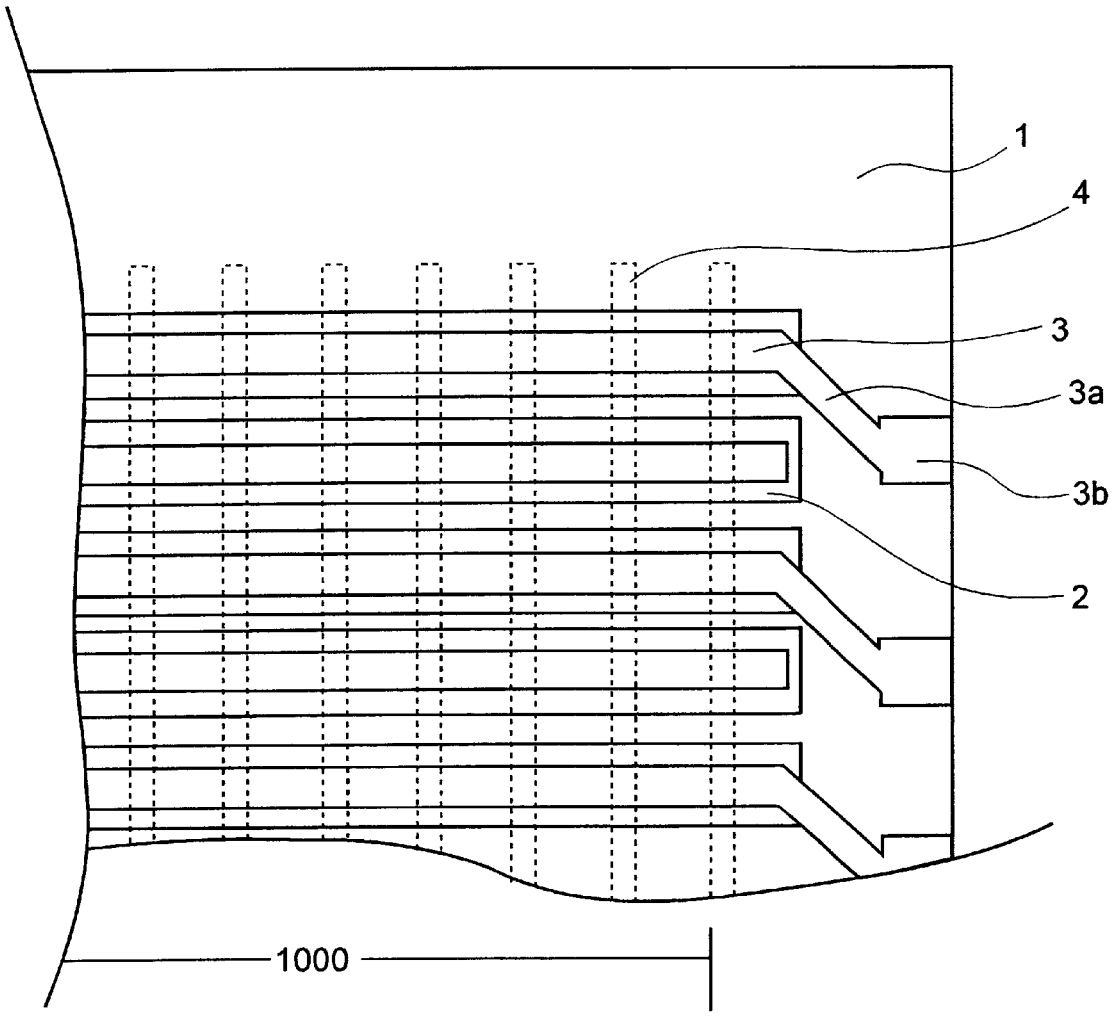
FIG. 13 is a detailed plan view illustrating one of the embodiments of this invention.
Figure 14:
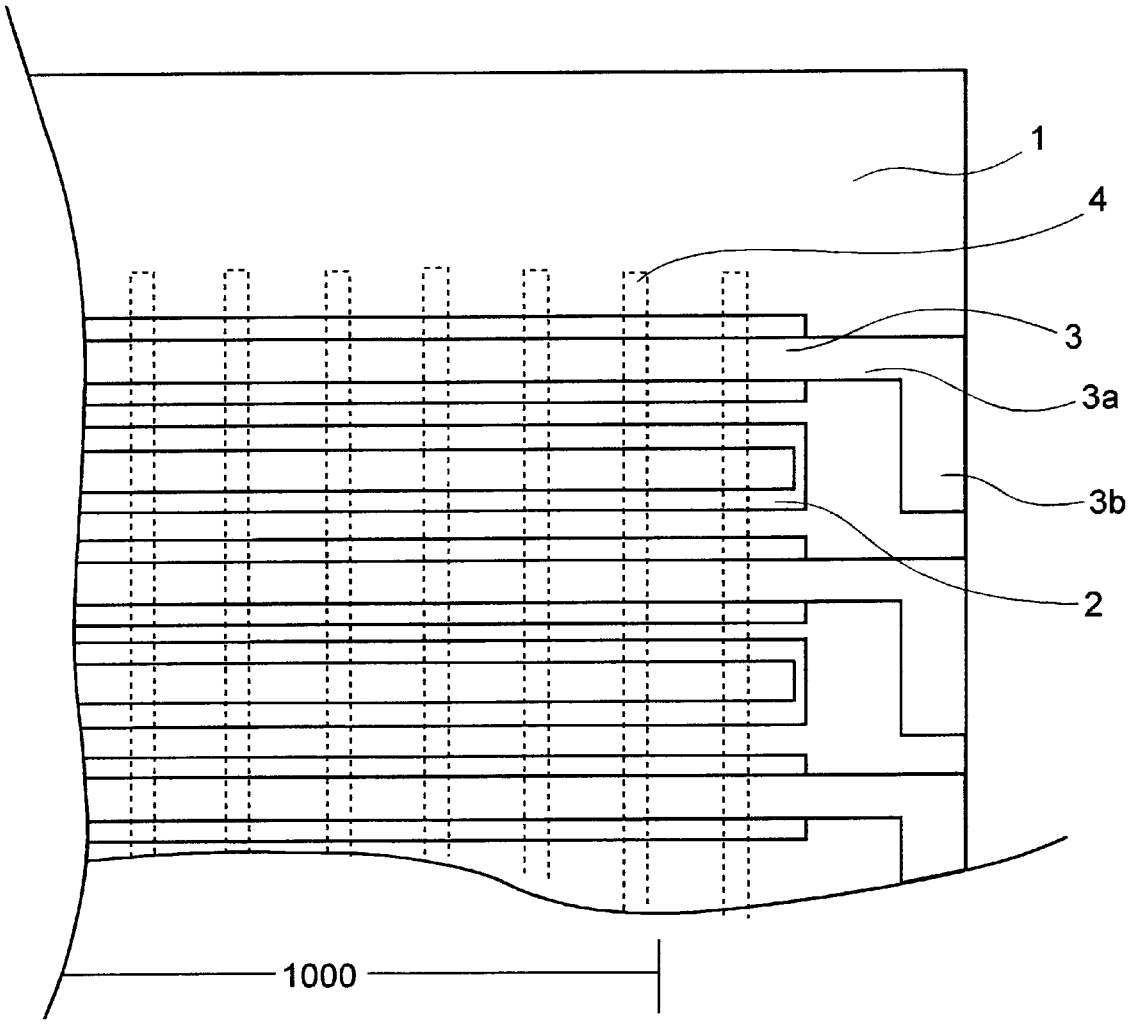
FIG. 14 is a detailed plan view illustrating one of the embodiments of this invention.

In this case, to obtain a stabilized discharging phenomenon, the edge of each display electrode 2 to be formed in a rectangular shape extends outside of the most outer barrier rib 4. That is, it is desirable for obtaining a stabilized discharge phenomenon that the edge of the display electrode 2 is positioned outside of this discharge area 1000. The discharge area 1000 is an area that operates as a picture display region of the gas discharging display device. Therefore, it is desirable when the limited range of the film-formed transparent electrode material shown in FIG. 1 is broader than this discharge area 1000. And, it is desirable that it does not short-circuit with the neighboring drawing wiring 3A. In addition, FIG. 13 and FIG. 14 illustrate examples of the panel after the glass substrate 1 is cut to the desired size.

As mentioned above, according to the structure of this invention, the manufacturing time and the overall throughput of manufacture of the gas discharging display panel are improved, because there is no obliquely directed wiring among the display electrodes 2. According to the structure of this invention, it is sufficient to scan a beam or a stage of the laser device in only the X or Y direction for forming the display electrodes 2.

Figure 5:
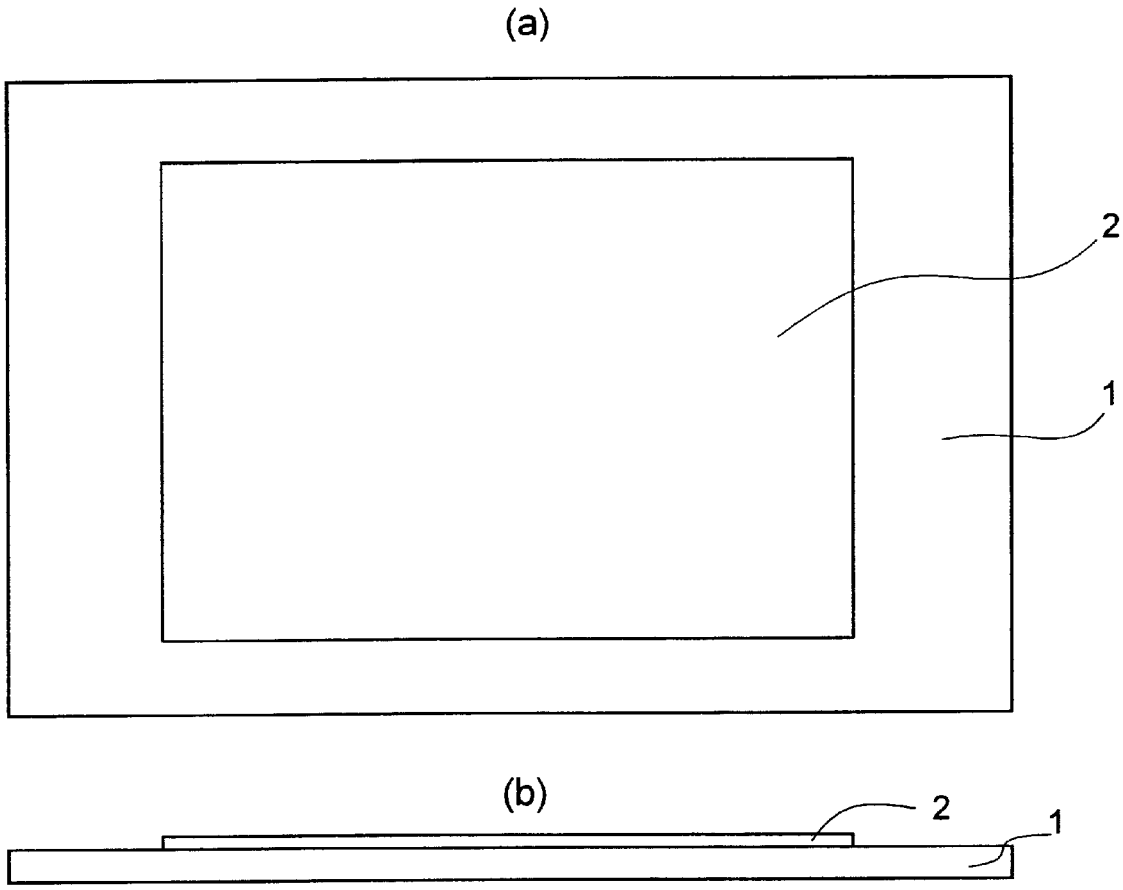
FIG. 5(*a*) is a top plan view and FIG. 5(*b*) is a side view of a substrate illustrating another one of the embodiments of this invention during a step of the manufacture thereof.
Figure 8:
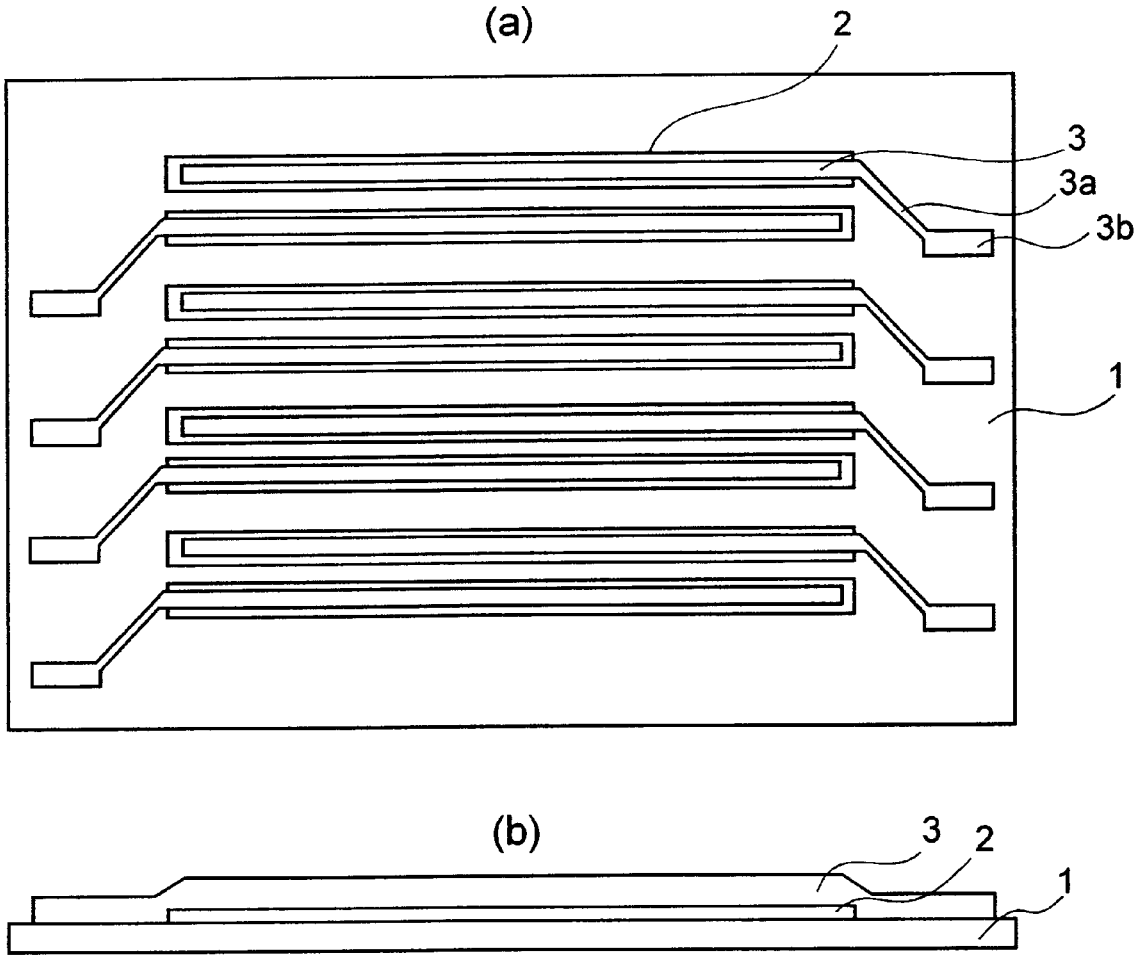
FIG. 8(*a*) is a top plan view and FIG. 8(*b*) is a side view of a substrate illustrating another one of the embodiments of this invention during a first step in the manufacture thereof.
Figure 16:
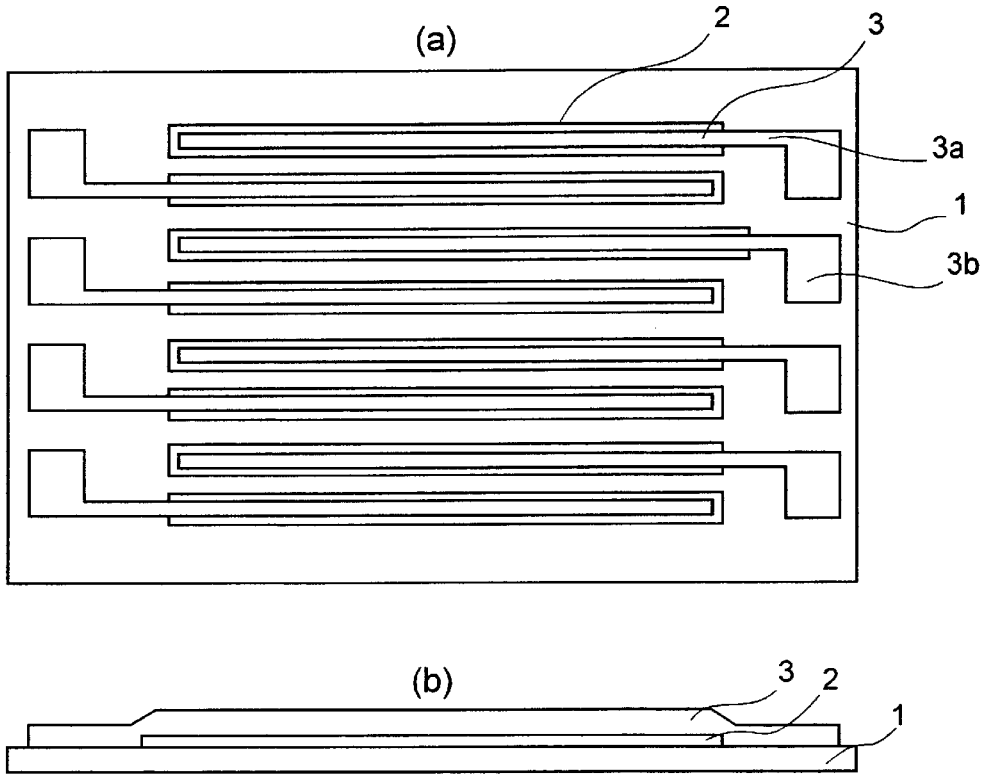
FIG. 16(*a*) is a top plan view and FIG. 16(*b*) is a side view of a substrate illustrating one of the embodiments of this invention.

FIG. 5(*a*)–FIG. 8(*b*) and FIG. 15(*a*)–FIG. 16(*b*) show other examples of forming the front substrate in accordance with the present invention.

Figure 6:
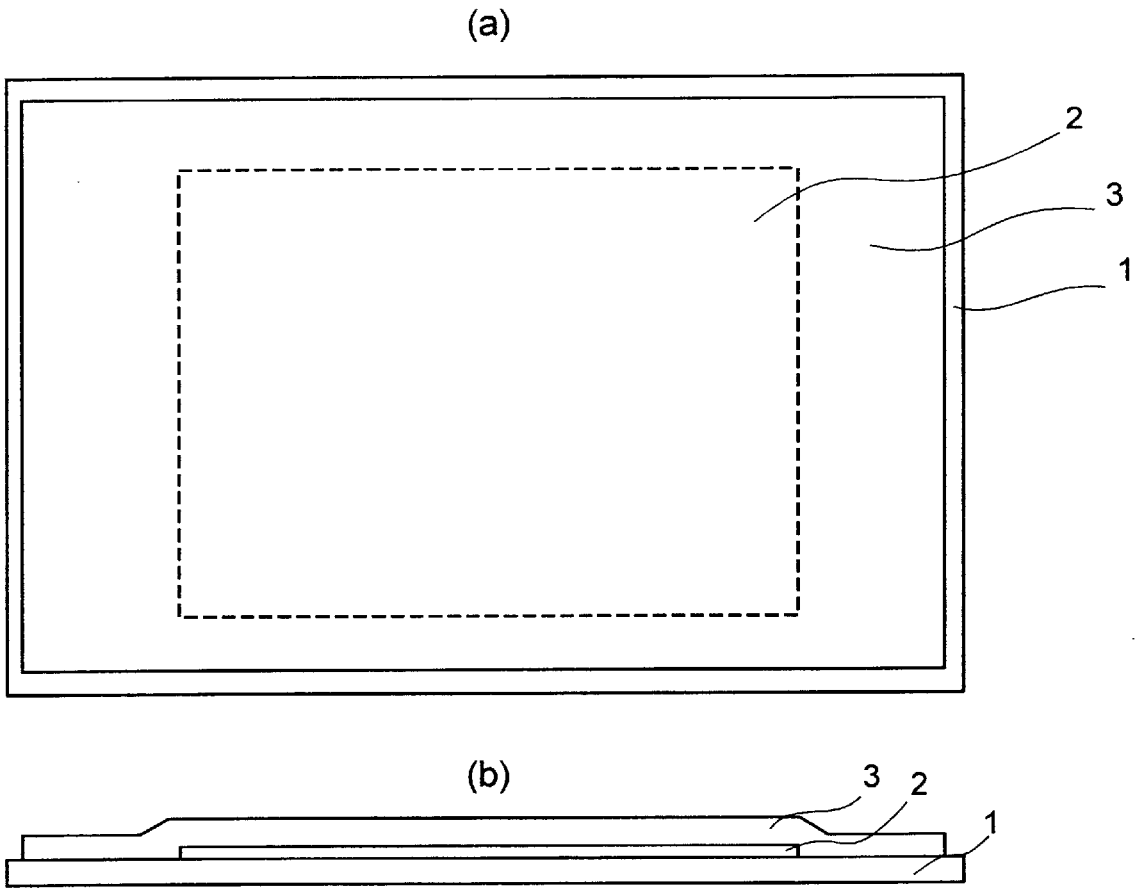
FIG. 6(*a*) is a top plan view and FIG. 6(*b*) is a side view of a substrate illustrating one of the embodiments of this invention during a subsequent step of the manufacture thereof.

First, as shown in FIG. 5(*a*) and FIG. 6(*a*), a transparent electrode material, such as ITO, is film-formed by sputtering in a limited range on the glass substrate 1. Next, some material for the bus electrode 3 is film-formed by sputtering to cover the film-formed ITO film.

Figure 7:
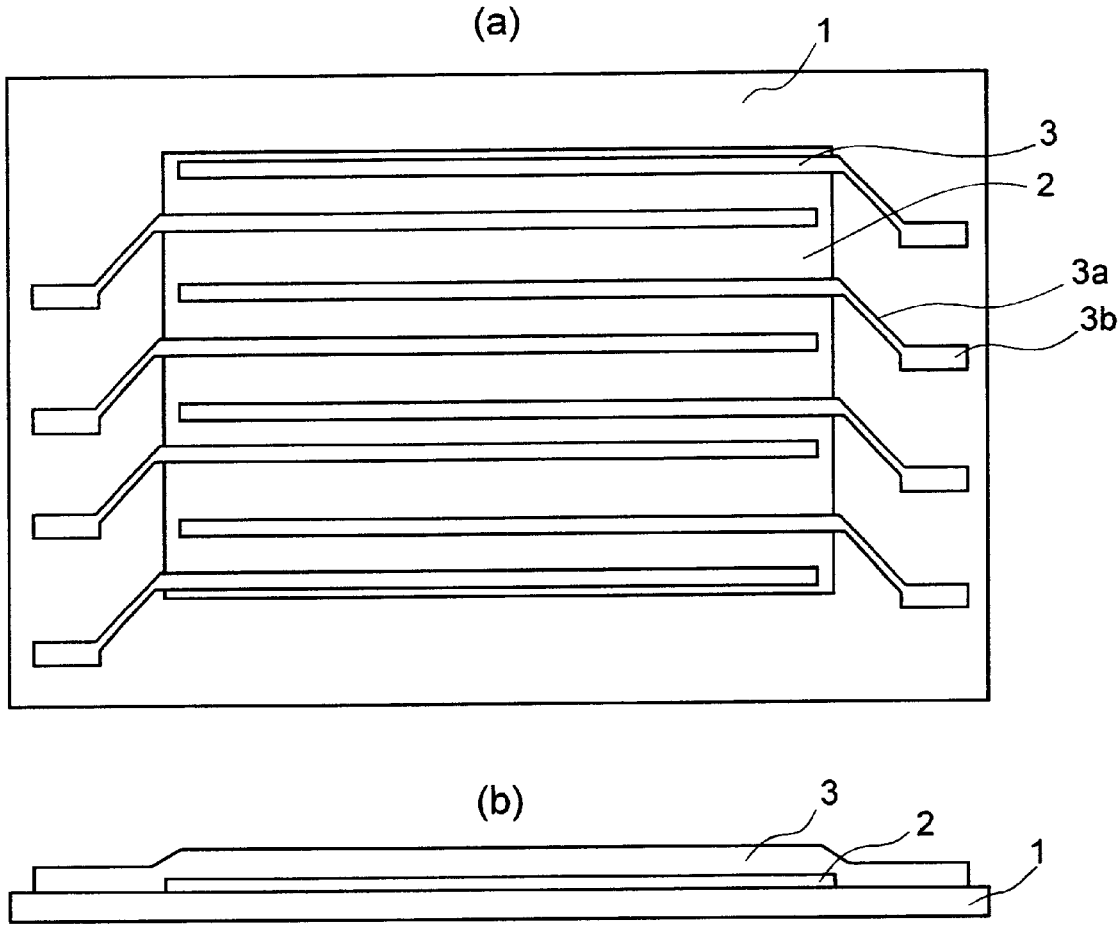
FIG. 7(*a*) is a top plan view and FIG. 7(*b*) is a side view of a substrate illustrating another one of the embodiments of this invention during a following step in the manufacture thereof.

Next, as shown in FIG. 7(*a*), the film-formed material for the bus electrode 3 is processed to form the bus electrodes 3 by a photolithography process and an etching process. These bus electrodes 3 extend from the display electrode 2 via a wiring 3*a* to the peripheral portion of the glass substrate 1 where an external connection terminal is provided for electrical connection with an external circuit. The external connection terminals 3*b* are arranged alternately on both sides of the glass substrate 1.

Lastly, as shown in FIG. 8, the layer of film-formed transparent electrode material, such as ITO, is processed by a laser device, such as YAG laser device, to form a plurality of rectangular display electrodes 2. In this case, the plurality of the display electrodes 2 are formed by only scanning a beam or a stage of the laser device in a constant direction. It is desirable when each X electrode or each Y electrode of the bus electrodes is a common electrode of the plasma display panel.

As mentioned above, according to the structure of this invention, the manufacturing time and the overall, throughput of the manufacture of the gas discharging display panel are improved, because there is no obliquely directed wiring among the display electrodes 2. According to the structure of this invention, it is sufficient to scan a beam or a stage of the laser device in the only the X or Y direction for forming the display electrodes 2.

Also, as shown in FIG. 15(*a*), it is possible to form the bus electrodes 3 by a laser process instead of a photolithography process. Each bus electrode 3 extends from a display electrode 2 via a wiring 3*a* to a peripheral portion of the glass substrate 1 where an external connection terminal 3A is provided for electrical connection to an external circuit. In this case, the external connection terminals 3*b* are arranged alternately on both ends of glass substrate 1. When one of the paired bus electrodes is an X electrode and the other of the paired bus electrodes 3 is a Y electrode, it is desirable for all X electrodes or all Y electrodes to be electrically connected with each other as a common electrode.

In FIG. 15(*a*) there is no oblique wiring among the bus electrodes 3 and the display electrodes 2, which makes it possible to shorten the manufacturing time of the bus electrodes 3. Each bus electrode 3 consists of a rectangular portion 3*b* for the external connection terminal and a rectangular bus electrode portion in the display area, and the wiring 3*a* drawn from the bus electrode portion in the display area to the external connection terminal portion 3*b* is also rectangular. It is possible to shorten the manufacturing time of the laser process with such a configuration. By turning the laser light on and off, the desired shape of the electrodes can be processed.

Lastly, as shown in FIG. 16(*a*), the layer of film-formed transparent electrode material, such as ITO, is processed by a laser device, such as YAG laser device, to form a plurality of rectangular display electrodes 2. In this case, the plurality of display electrodes 2 are formed by only scanning a beam or a stage of the laser device in a constant direction. It is desirable when each X electrode or each Y electrode of the bus electrode is a common electrode of the plasma display panel.

Finally, after films, such as the dielectric layer and the protective MgO layers, are film-formed, the front substrate is completed.

As mentioned above, if both the electrode material for the bus electrode 3 and the electrode material for the display electrodes 2 are film-formed, at first, the particles which are present at the time of laser manufacture of the display electrode 2 do not enter between the display electrode 2 and the bus electrode 3. Therefore, the occurrence of breakage of the wiring can be reduced more than the above example of this invention.

Figure 9:
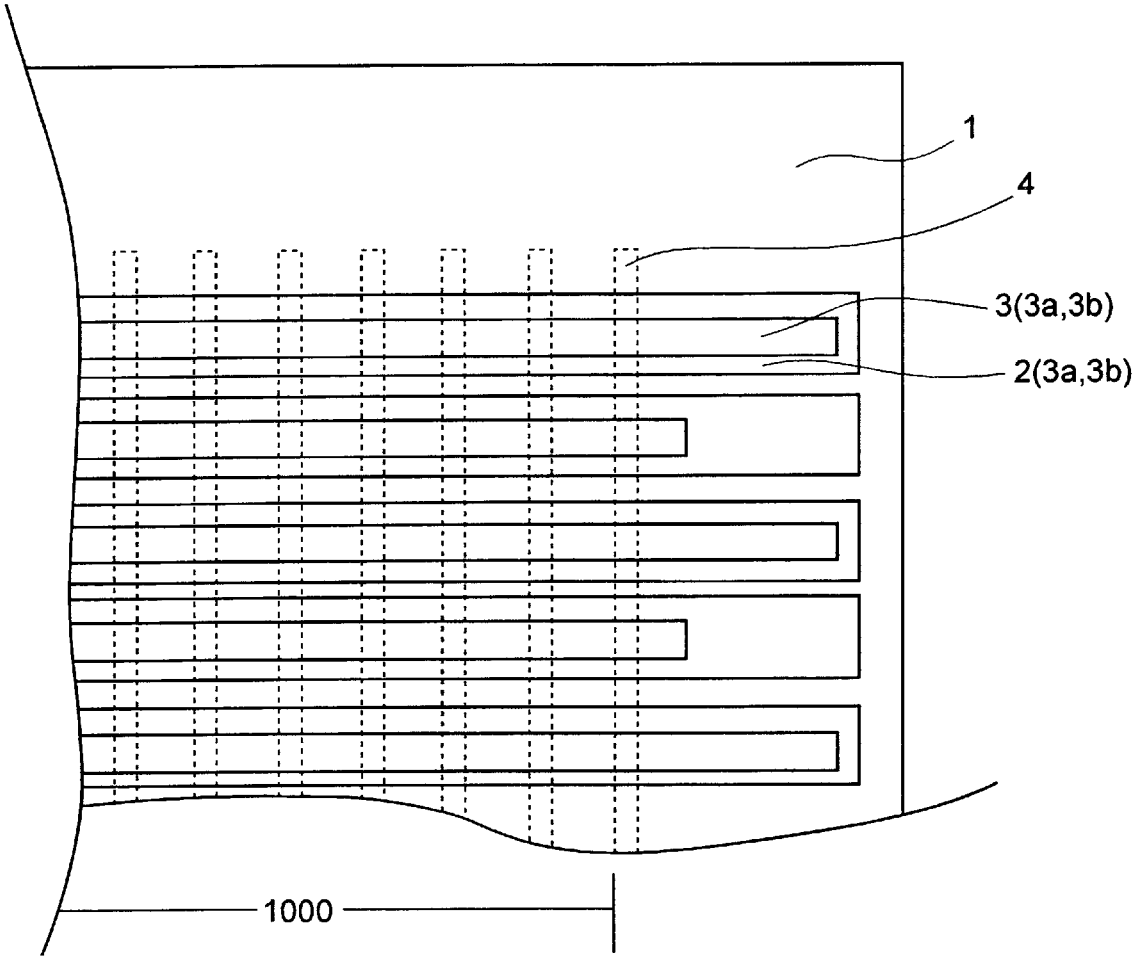
FIG. 9 is a detailed plan view illustrating another one of the embodiments of this invention.
Figure 10:
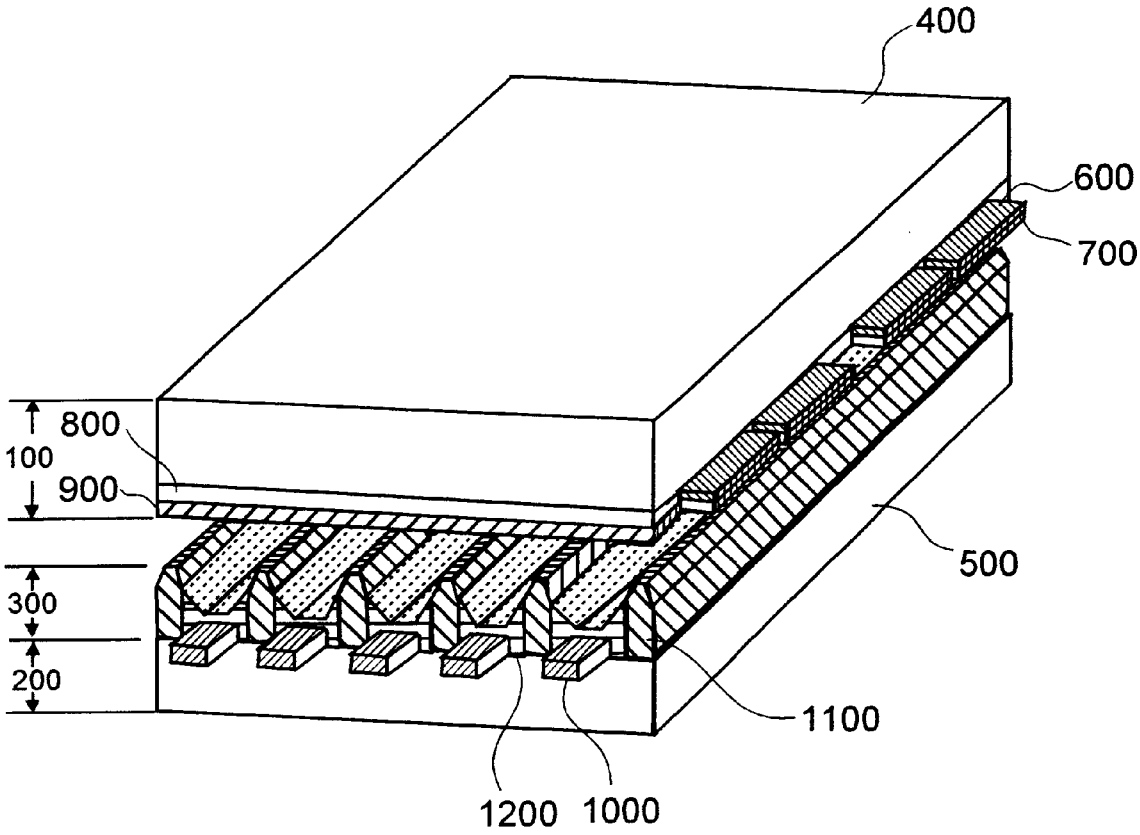
FIG. 10 is a perspective view illustrating a conventional gas discharge display panel.
Figure 17:
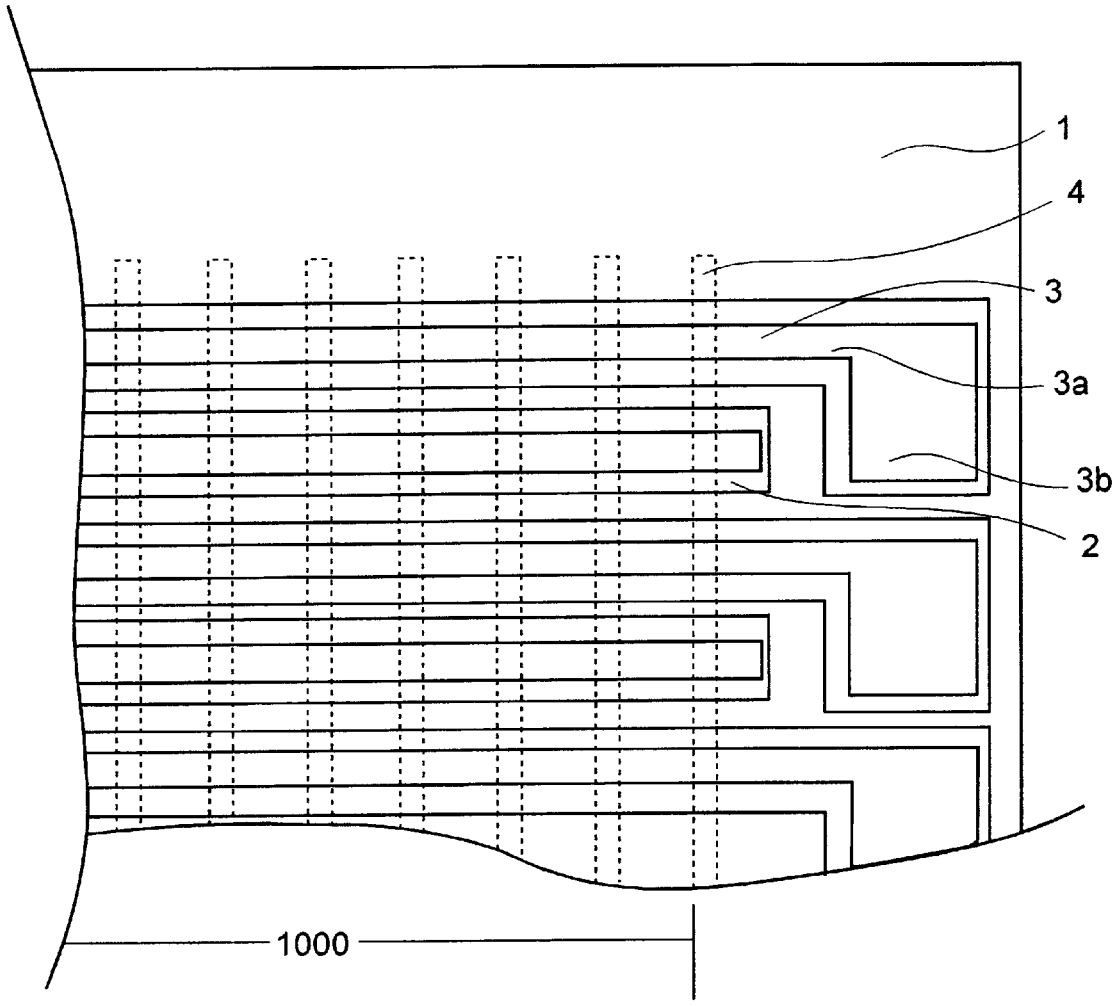
FIG. 17 is a detailed plan view illustrating one of the embodiments of this invention.

As shown in FIG. 9 and FIG. 17, it is possible to form both the display electrodes 2 and the bus electrodes 3 it is possible to extend to the peripheral portion of the glass substrate 1 where the external connection terminal 3*b* is formed. This structure can be produced by scanning a beam or a stage of the laser device in only the X or Y direction during manufacture of the device. Therefore, the manufacturing time for this electrode can be shortened even more than the above example of this invention. Both the display electrodes 2 and the bus electrodes 3 shown in FIG. 9 are rectangular in shape.

Figure 18:
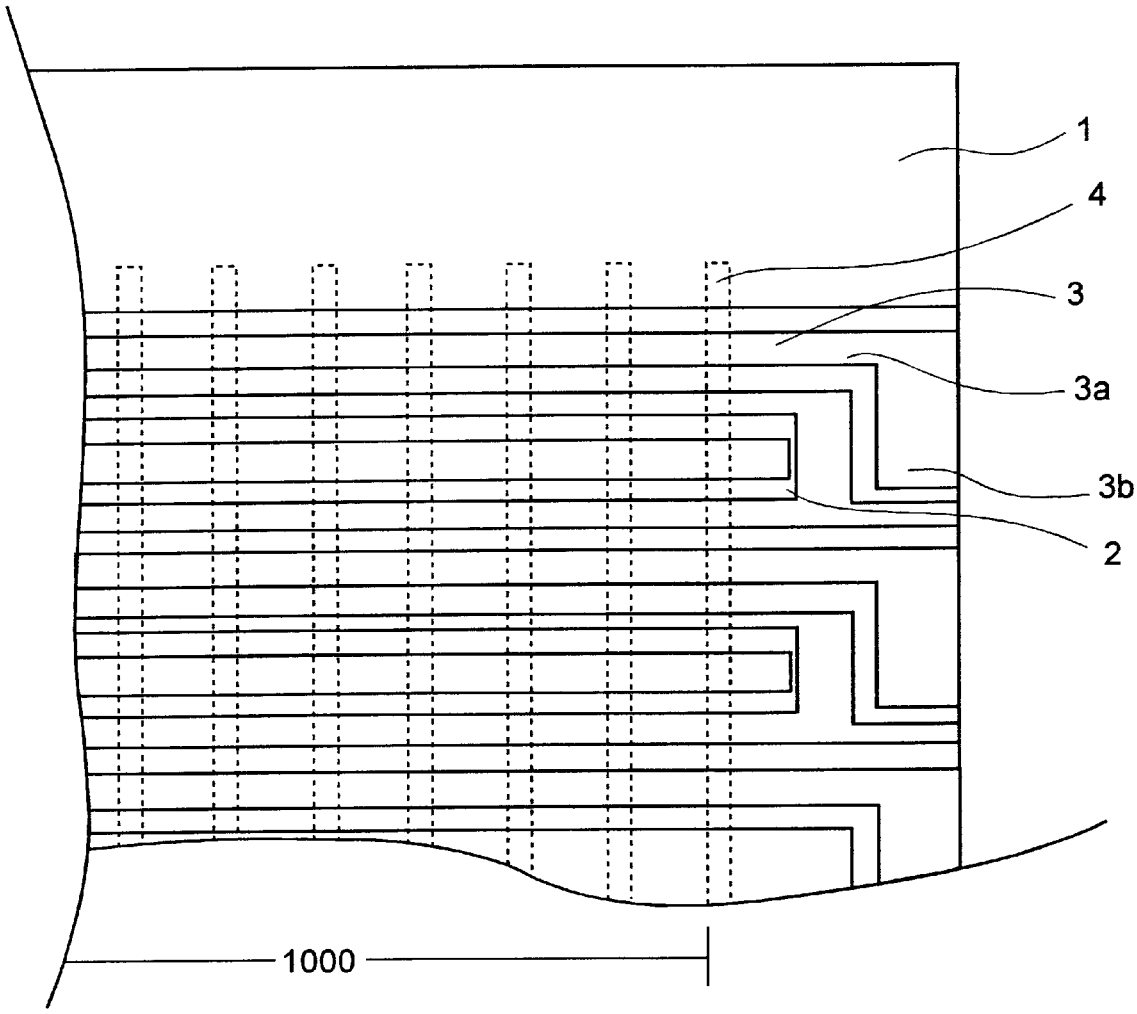
FIG. 18 is a detailed plan view illustrating one of the embodiments of this invention.

Lastly, FIG. 18 illustrates the panel after the glass substrate 1 has been cut to the desired size.

It is needless to say that, the same effect of the above embodiments can be obtained even the display electrodes 2 are formed on the bus electrodes 3. It is also needless to say that the same effect of the above embodiments can be obtained even if the technique of this invention is applied to other electrodes, such as address electrodes on the rear substrate.

In this description the word "rectangle" is not restricted only to the shape employed in the embodiments described above, but includes a rectangular shape having a short side or/and long side in the shape of a curve and a corner which is rounded. That is, a rectangular form is the shape which is obtained by scanning a beam or a stage of a laser device in substantially a constant direction, such as an X or Y direction, in the manufacture of the device.

According to the present invention, it is possible to shorten the laser processing time in the manufacture of an electrode of a gas discharge display panel.

What is claimed is:

1. A gas discharge display device comprising:

a first substrate;

a plurality of first electrodes having a substantially rectangular form being arranged on said first substrate;

a plurality of second electrodes, respective ones of said plurality of second electrodes being formed on respective ones of said plurality of first electrodes, each of said plurality of second electrodes having an extension extending beyond an end of a respective one of said plurality of first electrodes on which respective ones of said plurality of second electrodes are formed and in an oblique direction therefrom;

wherein the extension of said plurality of second electrodes extend beyond respective ends of alternate ones of said plurality of first electrodes.

2. A gas discharge display device according to claim 1, wherein the extension of said plurality of second electrodes connects with an external connection terminal.

3. A gas discharge display device according to claim 2, wherein the external connection terminal is arranged on said first substrate outside of a display area provided by said plurality of first and second electrodes.

4. A gas discharge display device according to claim 2, wherein the external connection terminal is arranged adjacent to an end of one of said plurality of first electrodes at which the extension of said second electrode extends beyond the end of an adjacent one of said plurality of first electrode.

5. A gas discharge display device according to claim 2, wherein the extension of said plurality of second electrodes extend in the oblique direction in a direction away from an end of an adjacent one of said plurality of first electrodes.

6. A gas discharge display device according to claim 1, wherein said plurality of first electrodes are arranged in parallel to one another.

* * * * *